US007175340B1

(12) United States Patent
Kinney

(10) Patent No.: US 7,175,340 B1
(45) Date of Patent: Feb. 13, 2007

(54) PROTECTIVE WATCH BAND ASSEMBLY

(76) Inventor: Joseph C. Kinney, P.O. Box 625, Semmes, AL (US) 36575

( * ) Notice: Subject to any disclaimer, the term of this patent is extended or adjusted under 35 U.S.C. 154(b) by 0 days.

(21) Appl. No.: 11/242,399

(22) Filed: Oct. 3, 2005

(51) Int. Cl.
*G04B 37/14* (2006.01)

(52) U.S. Cl. ..... 368/282; 368/281; 368/286

(58) Field of Classification Search ..... 368/281–283, 368/286; 224/168, 164, 176, 901.4, 170, 224/165, 171, 219, 1, 173; D10/31, 32
See application file for complete search history.

(56) References Cited

U.S. PATENT DOCUMENTS

| | | | | |
|---|---|---|---|---|
| 2,342,804 | A | 2/1944 | Hiller | |
| 2,442,912 | A | 6/1948 | Wheelock | |
| 2,619,270 | A | 11/1952 | Foster | |
| 3,737,082 | A | 6/1973 | Millman | |
| 3,991,921 | A | 11/1976 | Hirsch | |
| 4,047,651 | A | 9/1977 | McMullen | |
| 4,103,808 | A * | 8/1978 | Hallman et al. | 224/168 |
| 4,155,219 | A * | 5/1979 | Anderson | 368/282 |
| 5,636,775 | A * | 6/1997 | Kartsotis et al. | 224/165 |
| 5,812,500 | A * | 9/1998 | Webb, Jr. | 368/282 |
| 6,199,730 | B1 * | 3/2001 | Chisolm | 224/164 |
| 6,234,668 | B1 * | 5/2001 | Cooper | 368/281 |
| 6,276,580 | B1 | 8/2001 | Kitahara et al. | |
| 6,799,887 | B1 * | 10/2004 | Kinney | 368/282 |

* cited by examiner

*Primary Examiner*—Vit Miska
*Assistant Examiner*—Thanh S. Phan
(74) *Attorney, Agent, or Firm*—John Wiley Horton

(57) ABSTRACT

A protective watch band assembly including a protective watch band and an adapter. The protective watch band includes a pair of flaps on either side of an adapter receiver for attaching the adapter to the protective watch band. Hook and loop fasteners or other attachment means can be used to attach the two components of the present invention together. The adapter includes a pair of flaps on the top which are used to attach the watch face to the adapter by the watch face's band bars.

15 Claims, 3 Drawing Sheets

PROTECTIVE WATCH BAND ASSEMBLY

BACKGROUND OF THE INVENTION

1. Field of the Invention

This invention relates to the field of wearable timepieces. More specifically, the present invention comprises a protective watch band and adapter for protecting a wearer's watch face from damage.

2. Description of the Related Art

Wristwatches are one of the great conveniences of the modern age. Unfortunately, due to their exposed position, they are subject to damage. Virtually any type of physical labor puts a wristwatch in danger of being damaged. This is particularly true of construction labor and strenuous outdoor sports such as water skiing or scuba diving.

For those persons with expensive watches, the only option is often to remove the watch until the physical activity is done, leaving them with the ability to tell time. Alternatively, many wristwatch wearers elect to purchase a second inexpensive "sport" watch. Under either option, the wearer must remove the more expensive watch and leave it—subjecting it to potential loss or theft. Thus, there has been a long felt need for some type of protective device that would allow a wristwatch wearer to wear the watch during physical activity.

Such protective devices are known in the art. One example of such a device is described in the present inventor's previous patent, U.S. Pat. No. 6,799,887 B1 to Kinney (2004). The previous device uses an I-shaped cutout in the protective band to allow the band to be put on over the wearer's watch without requiring the wearer to remove the watch. The wearer simply wraps the protective band around the watch and inserts the watch face through the I-shaped cutout.

While this device is particularly effective for users who desire to simply cover their watch, the device is not effective at protecting some bands from being damaged by water or other elements. Some watch bands are made of leather or other materials that can be damaged or tarnish with exposure to water. Accordingly, individuals wearing these sorts of watch bands need further protection if they are going to engage in activities in or around the water.

BRIEF SUMMARY OF THE PRESENT INVENTION

The present invention comprises a protective watch band assembly including a protective watch band and an adapter. The protective watch band includes a pair of flaps on either side of an adapter receiver for attaching the adapter to the protective watch band. Hook and loop fasteners or other attachment means can be used to attach the two components of the present invention together. The adapter further includes a pair of flaps on the top which are used to attach the watch face to the adapter by the watch face's band bars.

REFERENCE NUMERALS IN THE DRAWINGS

Figure 1:
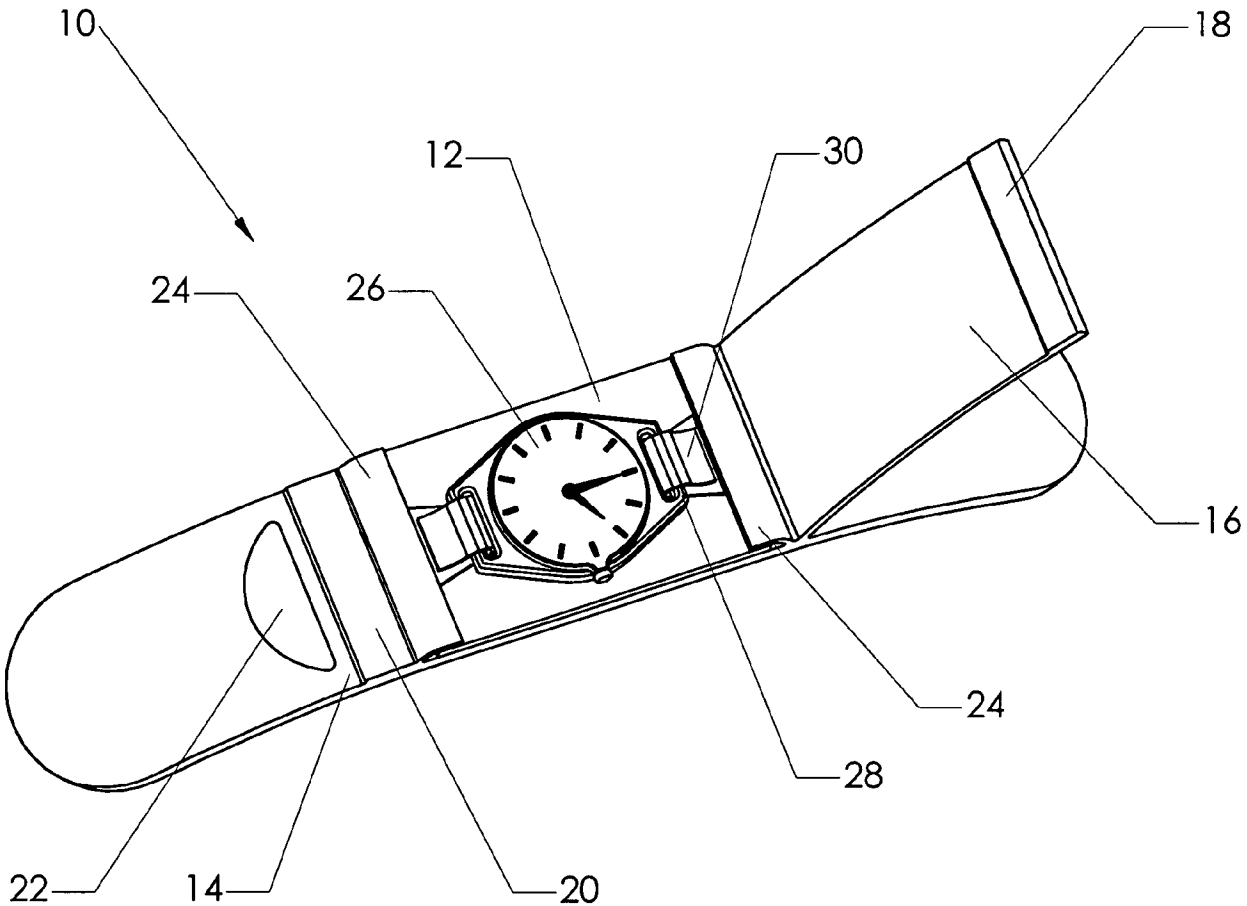
FIG. 1 is a perspective view, showing the present invention.

10 protective watch band assembly
12 adapter
14 protective watch band
16 protective flap
18 fastener
20 fastener
22 pocket
24 flap
26 watch face
28 band bar
30 flap
32 cutout
34 adapter receiver
36 end
38 end
40 fastener
42 top

DETAILED DESCRIPTION OF THE INVENTION

An illustration of the present invention, protective watch band assembly 10, is provided in FIG. 1. Protective watch band assembly 10 generally includes adapter 12 and protective watch band 14. In FIG. 1, adapter 12 is shown removably attached to protective watch band 14 by a pair of flaps 24. Similarly, watch face 26 is shown attached to adapter 12 by a pair of flaps 30. As shown in FIG. 1, each flap 30 wraps through the slot formed between the watch face and the band bar and attaches to itself. Although many types of attachment mechanisms can be used on flaps 24 and flaps 30, VELCRO-type hook-and-loop fasteners are a good choice because of their slim profile and ability to withstand a broad range of environmental and physical conditions.

In the preferred embodiment, protective watch band 14 also has protective flap 16 which can be wrapped across adapter 12 and watch face 26 to protect watch face 26 when the wearer is engaged in activities that could damage watch face 26. Protective flap 16 has fastener 18 which attaches to fastener 20 and holds protective flap 16 in position during such activities. Protective watch band 14 also includes pocket 22, which can be used to store money, jewelry, or other valuables.

Figure 2:
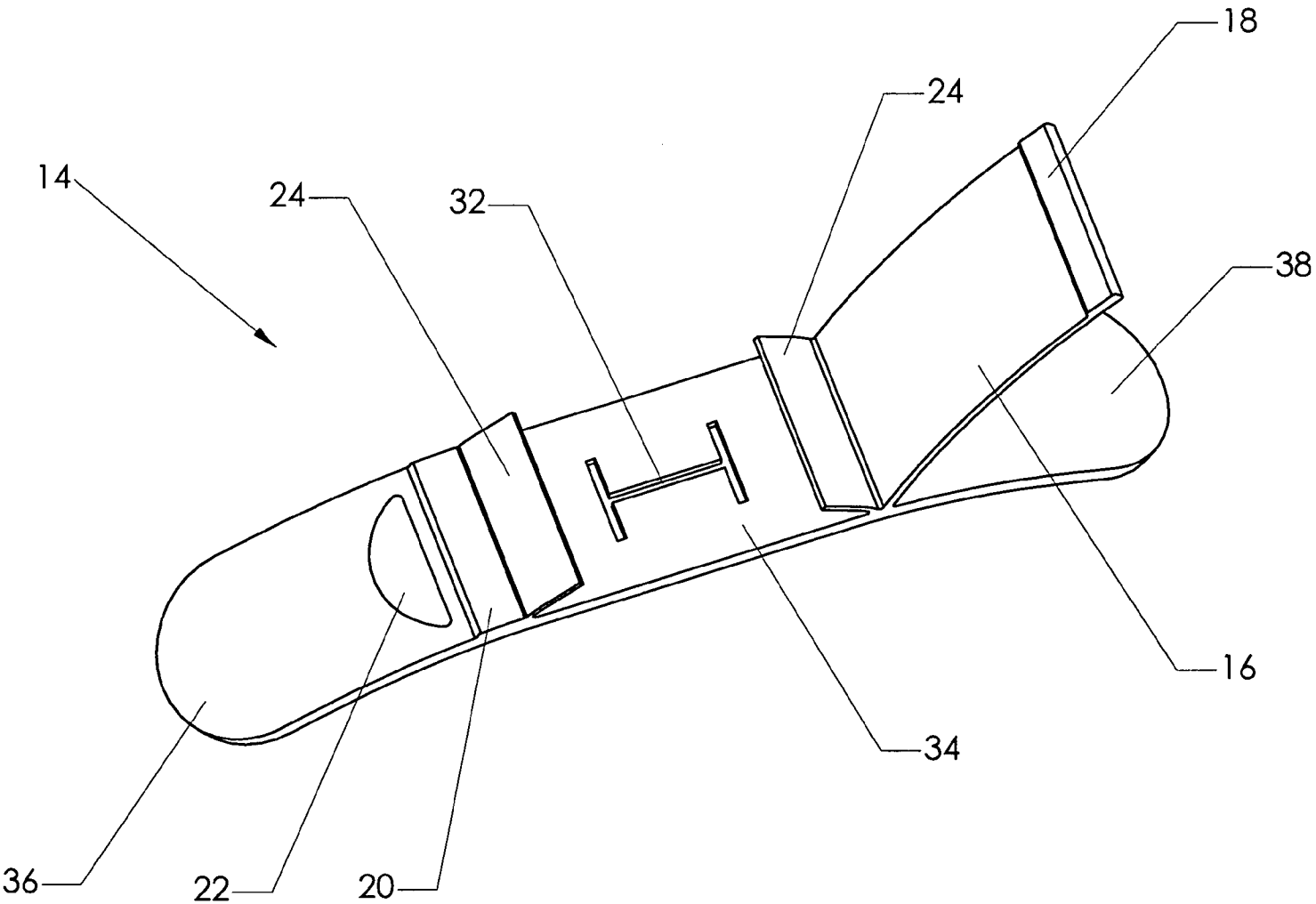
FIG. 2 is a perspective view, showing a perspective view of a protective watch band.

Protective watch band 14 is shown in greater detail in FIG. 2. Protective watch band 14 is generally composed of a sturdy piece of material such as a nylon-weaved fabric which extends from end 36 to end 38. End 36 and end 38 fasten together around the wearer's wrist. Various fastening mechanisms can be used to attach end 36 and end 38 including VELCRO-type hook-and-loop fasteners, snaps, buttons, and buckles.

A pair of flaps 24 are attached to the medial section between end 36 and end 38. Flap 24 is attached to protective watch band 14 by one of the ends of flap 24 while the other end of flap 24 is allowed to move relatively freely. The area between flaps 24 on protective watch band 14 forms adapter receiver 34. The side of each flap 24 facing adapter receiver 34 includes an attachment means for attaching adapter 12 to protective watch band 14. Many types attachment means can be used for attaching the two components of the assembly together including all of the fastening mechanisms mentioned above for attaching end 36 to end 38.

In the preferred embodiment adapter receiver 34 includes I-shaped cutout 32 so that protective watch band 14 can optionally be placed around the wearer's wrist on top of a wrist watch. The face of the wrist watch can be inserted through cutout 32. Accordingly, the wearer does not have to remove their wristwatch in order to use protective watch band 14. The reader will note that I-shaped cutout 32 typically will not be used if the wearer is also using adapter 12 as adapter 12 would cover the watch face.

In addition, adapter receiver 34 can include an additional attachment means to help secure adapter 12 to protective watch band 14. This additional attachment means can also be used to retain flaps 24 to adapter receiver 34 when adapter 12 is not used. For example, hook fasteners may be used on flap 24 and loop fasteners may be used on adapter receiver 34. Therefore, if the wearer is not using adapter 12, flaps 24 will firmly attach to adapter receiver 34 and not interfere with the wearer's comfort.

Figure 3:
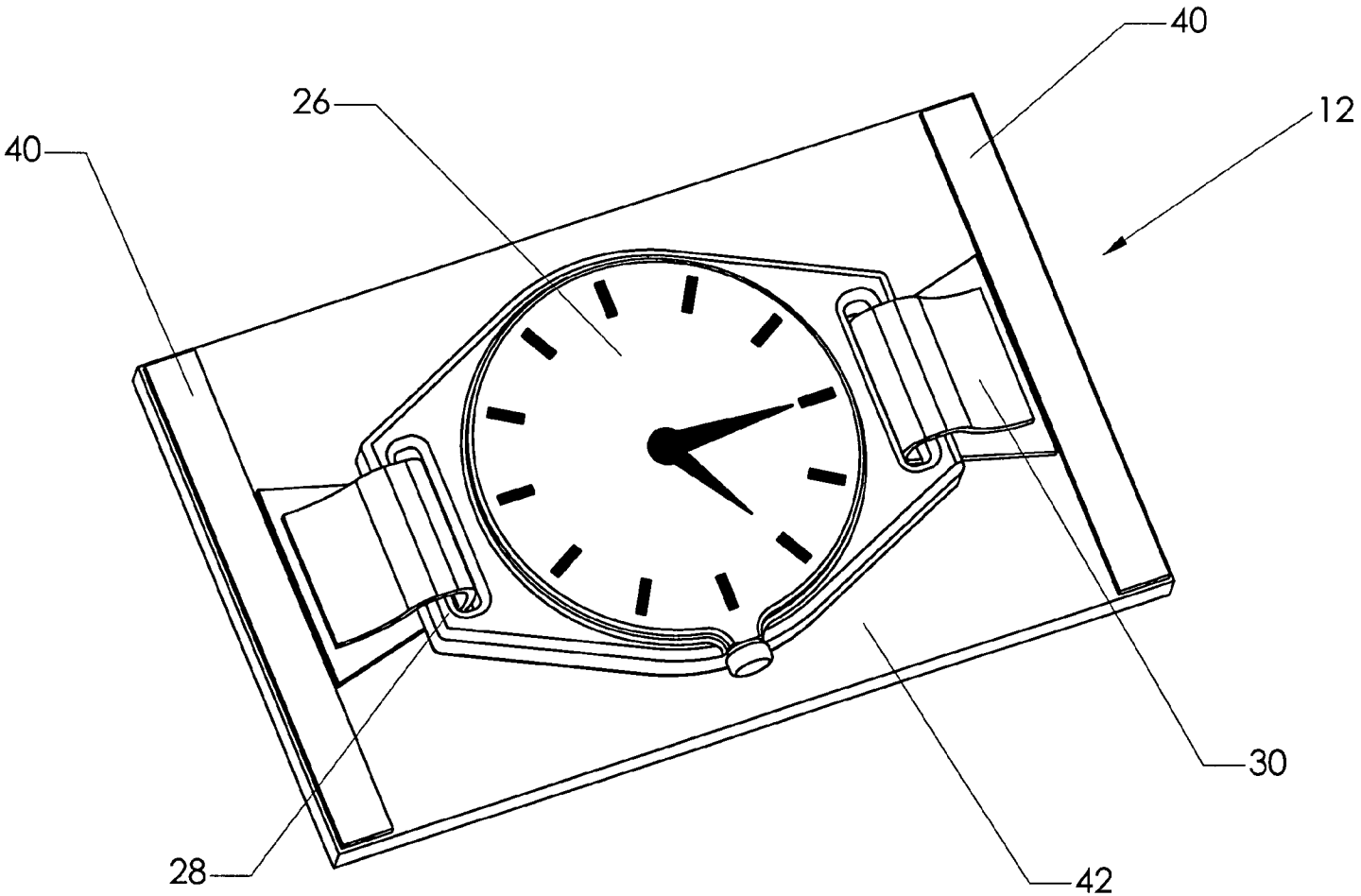
FIG. 3 is a perspective view, showing an adapter.

A detailed illustration of adapter 12 is provided in FIG. 3. Adapter 12 has a pair of fasteners 40 corresponding to flaps 24 on both ends of top 42. Accordingly, if hook fasteners are used on flaps 24, then loop fasteners would be used as fastener 40. Any sort of attachment means, however, can be used for fastener 40.

A pair of flaps 30 are positioned near each end of adapter 12 on top of adapter 12 and are used for attaching watch face 26 to adapter 12. As illustrated in FIG. 3, watch face 26 has a pair of band bars 28 on either end. Conventionally, band bars 28 are used to attach the standard watch band to watch face 26. In the preferred embodiment, flaps 30 arap around band bars 28, thereby attaching watch face 26 to adapter 12. Although any attachment means can be used to attach flap 30 to band bar 28, hook and loop fasteners are a good choice. The top portion of flap 30 can be provided with hook fasteners while the bottom portion of flap 30 can be provided with loop fasteners. Accordingly, when flap 30 is wrapped around band bar 28, the top portion of flap 30 can be attached to the bottom potion of flap 30.

In addition, if an additional attachment means is used on adapter receiver 34, the appropriate attachment means can also be applied to the back side of adapter 12. For example, if loop fasteners are employed on adapter receiver 34 as mentioned previously, hook fasteners can be employed on the back side of adapter 12. The additional attachment means prevents adapter 12 from becoming accidentally detached from protective watch band 14 even if flaps 24 become accidentally detached from fasteners 40.

The preceding description contains significant detail regarding the novel aspects of the present invention. It should not be construed, however, as limiting the scope of the invention but rather as providing illustrations of the preferred embodiments of the invention. As an example, various attachment means can be used for attaching the adapter to the protective watch band and the watch face to the adapter. Such a variation would not alter the function of the invention. Thus, the scope of the invention should be fixed by the following claims, rather than by the examples given.

Having herein described my invention, I claim:

1. A protective watch band assembly for a watch face having a first band bar and a second band bar, said protective watch band comprising:

a. a protective band, said protective band having a first side, a second side, a first end, a second end, a medial section therebetween, said protective band including i. a first flap, having a first side and a second side, said first flap attached to said first side of said protective band at said medial section;

ii. a second flap, having a first side and a second side, said second flap attached to said first side of said protective band at said medial section;

iii. an adapter receiver, said adapter receiver positioned between said first flap and said second flap;

b. an adapter, having a first end, a second end, a front side and a back side, said adapter including i. a first attachment means, said first attachment means positioned proximal to said first end of said adapter on said front side;

ii. a second attachment means, said second attachment means positioned proximal to said second end of said adapter on said front side;

c. wherein said first flap is configured to wrap over and attach to said first attachment means of said adapter and said second flap is configured to wrap over and attach to said second attachment means of said adapter when said adapter is positioned proximal to said adapter receiver.

2. The protective watch band assembly of claim 1, said adapter further comprising a third attachment means positioned on said back side of said adapter, said third attachment means configured to attach to said adapter receiver.

3. The protective watch band assembly of claim 1, said adapter further comprising:

a. a first flap positioned proximal to said first end of said adapter on said front side of said adapter;

b. a second flap positioned proximal to said second end of said adapter on said front side of said adapter;

c. wherein said first flap is configured to attach to said first band bar of said watch face; and d. wherein said second flap is configured to attach to said second band bar of said watch face.

4. The protective watch band assembly of claim 2, said adapter further comprising:

a. a first flap positioned proximal to said first end of said adapter on said front side of said adapter;

b. a second flap positioned proximal to said second end of said adapter on said front side of said adapter;

c. wherein said first flap is configured to attach to said first band bar of said watch face; and d. wherein said second flap is configured to attach to said second band bar of said watch face.

5. The protective watch band assembly of claim 1, said protective watch band further comprising a protective flap, said protective flap attached to the first side of said protective watch band between said first end and said first flap, said protective flap configured to wrap over said adapter and removably attach to said protective watch band between said second end and said second flap.

6. The protective watch band assembly of claim 2, said protective watch band further comprising a protective flap, said protective flap attached to the first side of said protective watch band between said first end and said first flap, said protective flap configured to wrap over said adapter and removably attach to said protective watch band between said second end and said second flap.

7. The protective watch band assembly of claim 3, said protective watch band further comprising a protective flap, said protective flap attached to the first side of said protective watch band between said first end and said first flap, said protective flap configured to wrap over said adapter and removably attach to said protective watch band between said second end and said second flap.

8. The protective watch band assembly of claim 4, said protective watch band further comprising a protective flap, said protective flap attached to the first side of said protective watch band between said first end and said first flap, said protective flap configured to wrap over said adapter and removably attach to said protective watch band between said second end and said second flap.

9. A protective watch band assembly for attachment to an adapter, said protective watch band comprising:

a. a protective band, said protective band having a first side, a second side, a first end, a second end, a medial section therebetween, said protective band including
   i. a first flap, having a first end, a second end, a first side and a second side, said first end of said first flap attached to said first side of said protective band at said medial section, said first side of said first flap facing said medial section;
   ii. a second flap, having a first end, a second end, a first side and a second side, said first side of said second flap attached to said first side of said protective band at said medial section, said first side if said second flap facing said medial section
   iii. an adapter receiver, said adapter receiver positioned between said first flap and said second flap;

b. a first attachment means for attaching said adapter to said protective watch band, said first attachment means situated on said first side of said first flap; and c. a second attachment means for attaching said adapter to said protective watch band, said second attachment means situated on said first side of said second flap.

10. The protective watch band assembly of claim 9, wherein said first attachment means is selected from a group consisting of:

a. hook fasteners;
b. loop fasteners;
c. snaps; and
d. buttons.

11. The protective watch band assembly of claim 9, further comprising a third attachment means for attaching said adapter to said protective watch band, said third attachment means situated on said adapter receiver.

12. The protective watch band assembly of claim 9, said protective watch band further comprising a protective flap, said protective flap attached to the first side of said protective watch band between said first end and said first flap, said protective flap configured to wrap over said adapter and removably attach to said protective watch band between said second end and said second flap.

13. A protective watch band assembly for attaching a watch face having a first band bar and a second band bar to a protective watch band, said protective watch band assembly comprising:

a. an adapter, having a first end, a second end, a front side and a back side, said adapter including
   i. a first flap positioned proximal to said first end of said adapter on said front side of said adapter;
   ii. a second flap positioned proximal to said second end of said adapter on said front side of said adapter;
   iii. wherein said first flap is configured to attach to said first band bar of said watch face;
   iv. wherein said second flap is configured to attach to said second band bar of said watch face;

b. a first attachment means for attaching said adapter to said protective watch band, said first attachment means positioned proximal to said first end of said adapter on said front side of said adapter; and c. a second attachment means for attaching said adapter to said protective watch band, said second attachment means positioned proximal to said second end of said adapter on said front side of said adapter.

14. The protective watch band assembly of claim 13, wherein said first attachment means is selected from a group consisting of:

a. hook fasteners;
b. loop fasteners;
c. snaps; and
d. buttons.

15. The protective watch band assembly of claim 13, further comprising a third attachment means for attaching said adapter to said protective watch band, said third attachment means situated on said back side of said adapter.

* * * * *